US005303538A

United States Patent [19]

Pagura et al.

[11] Patent Number: 5,303,538

[45] Date of Patent: Apr. 19, 1994

[54] DEVICE AND PROCEDURE FOR PREPARING THE THREAD END TO START OR RESUME OPEN-END SPINNING

[75] Inventors: Ernesto Pagura, Zoppola; Donato Castellarin, Zaazzano Decimo; Francesco Ferro, Pordenone, all of Italy

[73] Assignee: Savio S.p.A., Pordenone

[21] Appl. No.: 958,540

[22] Filed: Oct. 8, 1992

Related U.S. Application Data

[63] Continuation of Ser. No. 659,040, Feb. 21, 1991, abandoned.

[30] Foreign Application Priority Data

Feb. 23, 1990 [IT] Italy ..... 19472 A/90

[51] Int. Cl.[5] ..... D01H 15/02

[52] U.S. Cl. ..... 57/263; 57/261; 57/278

[58] Field of Search ..... 57/22, 261, 263, 264, 57/278

[56] References Cited

U.S. PATENT DOCUMENTS

| | | | |
|---|---|---|---|
| 3,924,393 | 12/1975 | Stahlecker et al. | 57/263 |
| 3,924,394 | 12/1975 | Stahlecker et al. | 57/263 |
| 3,925,975 | 12/1975 | Stahlecker et al. | 57/263 |
| 3,962,855 | 6/1976 | Stahlecker | 57/34 R |
| 4,276,741 | 7/1981 | Stahlecker et al. | 57/263 |
| 4,489,544 | 12/1984 | Morita et al. | 57/261 |
| 4,494,371 | 1/1985 | Morita et al. | 57/263 |
| 4,507,427 | 2/1986 | Premi et al. | 57/22 |
| 4,628,684 | 12/1986 | Morita et al. | 57/263 |
| 4,653,260 | 3/1987 | Arzt et al. | 57/263 |
| 4,672,802 | 6/1987 | Raasch | 57/263 |
| 4,888,943 | 12/1989 | Cottenceau et al. | 57/22 |
| 4,920,739 | 5/1990 | Raasch | 57/263 |

FOREIGN PATENT DOCUMENTS

| | | |
|---|---|---|
| 2350842 | 4/1975 | Fed. Rep. of Germany . |
| 2350843 | 4/1975 | Fed. Rep. of Germany . |
| 2361787 | 6/1975 | Fed. Rep. of Germany . |
| 2712644 | 9/1978 | Fed. Rep. of Germany . |
| 3804684 | 9/1988 | Fed. Rep. of Germany . |
| 3809437 | 10/1988 | Fed. Rep. of Germany . |
| 3823725 | 1/1989 | Fed. Rep. of Germany . |
| 3824850 | 2/1989 | Fed. Rep. of Germany . |
| 3911018 | 10/1989 | Fed. Rep. of Germany . |
| 2254661 | 12/1974 | France . |
| 1480399 | 7/1977 | United Kingdom . |

*Primary Examiner*—Daniel P. Stodola
*Assistant Examiner*—William Stryjewski
*Attorney, Agent, or Firm*—Shea & Gould

[57] ABSTRACT

The thread end to be used for rejoining in an open-end spinning frame is prepared by cutting it to size and then introducing it into a pipe with a vigorous air flow running through the pipe and contacting the thread end with a vibrating blade, freeing the end of short fibers, tapering the thread end and untwisting the fibers that comprise the thread end.

10 Claims, 2 Drawing Sheets

FIG. 2A
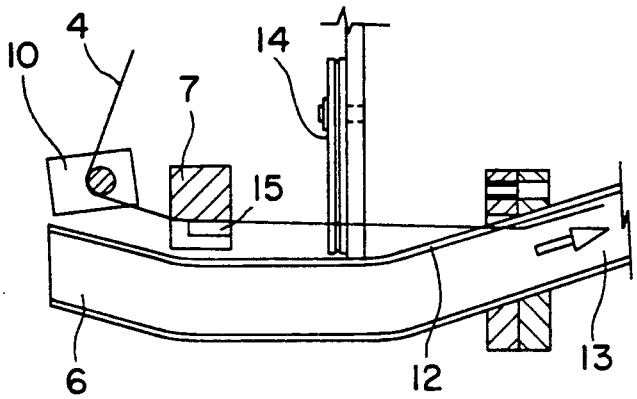
FIG. 2C
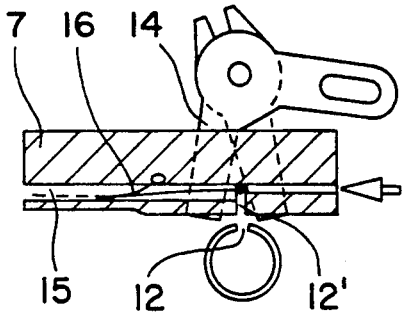
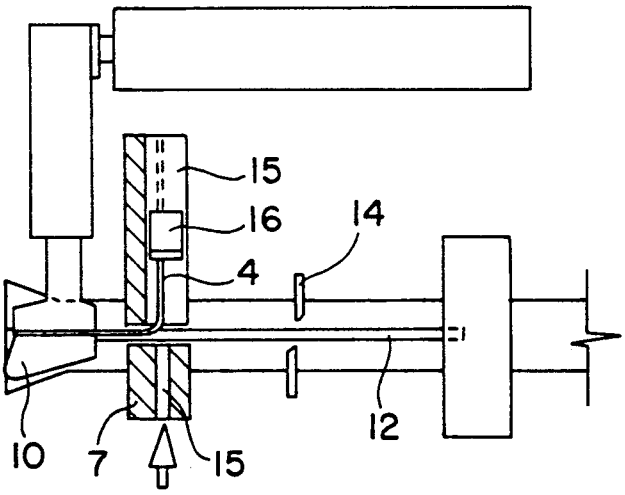
FIG. 2B

DEVICE AND PROCEDURE FOR PREPARING THE THREAD END TO START OR RESUME OPEN-END SPINNING

This is a continuation of application Ser. No. 07/659,040, filed Feb. 21, 1991, now abandoned.

The present invention relates to open-end spinning and in particular concerns starting or resuming open-end spinning, in which a ring of singularised fibers is deposited in the groove of a rotor that turns at very high speeds, into which is reintroduced one end of the thread which links with the singularised fibers deposited in the groove.

By extracting the end thus introduced, thread production is resumed, the thread being twisted by the rotation of the rotor. The thread is extracted by the extraction rollers and wound onto reels.

The number of twists imparted to the thread is proportional to the ratio between the rotor speed and the thread extraction speed.

In an open-end or free-end spinning frame the thread must be rejoined on starting or, more frequently, when the thread is broken or when production of a new reel is begun, having completed the previous reel.

In order to perform this operation correctly, the end is reintroduced into the rotor using devices which ensure that a precisely-determined length of thread is inserted into the rotor, at controlled times and speeds of the various organs involved.

In order produce a good-quality yarn, in the section of thread produced in the joining operation between the end introduced into and fibers picked up from the rotor, the yarn must not be irregular or of a different diameter and must be of the same strength. In other words, in good-quality yarns the sections in which rejoining has taken place must be the same as the rest of the yarn.

If this is not the case, the yarn produced must undergo an additional spooling operation to eliminate imperfections due to irregularities in the diameter or twists, to weak points and so on.

In order to achieve a proper connection between the singularised fibers and the thread end reintroduced into the rotor with an opposite motion to that of extraction, in the state of the art it is known that the said end must be properly prepared, removing from it the existing twists and making the fibers that comprise it essentially parallel, in order to improve penetration between the fibers of the reintroduced end and the singularised fibers deposited in the rotor.

The end must be tapered so as to prevent there being a thickened section at the rejoining point.

During such preparation it is very important also to remove shorter fibers, damaged both when breaking the thread and during the actual preparation operation. These fibers would cause the join to have a lower mechanical strength.

BACKGROUND OF THE INVENTION

In the state of the art very diverse methods of preparing the end have been described.

In UK Patent No. 1480399 in the name of Stahlecker, the thread is prepared by picking up the thread end by means of a rotating gripper and subsequently untwisting the thread by rotating the gripper in the opposite direction to the direction of twisting. This thread preparation method has its drawbacks since from time to time the thread end may have a different and indeterminate residual twist. In fact the free end tends to untwist spontaneously, at least in part, and this untwisting spreads along the thread. It is not possible, therefore, to predict beforehand how many turns the gripper must make in order to render the fibers essentially parallel. If these turns are too few, the fibers of the thread end are again twisted; if, however, the turns are too many, the fibers are twisted in the opposite direction. This gripper also pulls the thread damaging its fibers.

In U.S. Pat. No. 3,925,975, in the name of Stahlecker, the thread end is untwisted by pairs of rubbing pads. This type of preparation is also affected by the degree of variability of the twist condition of the thread end.

Moreover, in the state of the art, in spinning frames currently in production, rapidly rotating milling cutter devices are used, the thread being brought towards them, stretched out by the effect of an air suction flow. Milling of the thread produces a tapered thread end with the fibers parallelised by the stress induced by the projections of the milling cutter.

The drawbacks of this technical solution are that the end thus prepared is not of a constant length, the milling cutter wears and becomes blocked due to coils of yarn winding round it and the thread end is insufficiently tapered. The fibers are shortened by the action of the milling cutter.

An alternative technical solution applied industrially comprises a preparation device in which the milling cutter is replaced by a rotating abrasive disc or other abrasive bodies, as in German Patents Nos. 2350842 and 2350843 in the name of Stahlecker. Other state of the art methods of preparing the end consist in cutting the thread to the required size and untwisting and fraying out the end with jets of air directed at right angles, parallel or inclined in relation to the axis of the thread, eliminating the twists and removing the short fibers, as in German Patent No. 2361787 in the name of Stahlecker.

This type of preparation produces an insufficiently tapered end, giving rise to a strong but thickened join which gives an irregular and variable result.

SUMMARY OF THE INVENTION

The present invention concerns the treatment for preparing the end to be used when rejoining the thread in an open-end spinning frame performed by cutting the thread end in order to introduce it into a confined space where it is treated in an air flow in contact with a vibrating blade, which tapers the end and removes the shorter fibers. This treatment gives an end, to be introduced into the spinning rotor, of a constant length, well tapered, with the fibers free and not tangled together.

BRIEF DESCRIPTION OF THE DRAWINGS

FIGS. 2A, 2B and 2C show, respectively, side, plan and cross-sectional views of the preparation device according to the invention.

DESCRIPTION OF THE PREFERRED EMBODIMENTS

In order better to understand the characteristics and advantages of the present invention, one of its typical embodiments is described, shown in FIGS. 1 and 2, given for the purpose of illustration but in no way limiting, including also the operations that precede and follow preparation of the thread end according to the present invention.

Figure 1B:
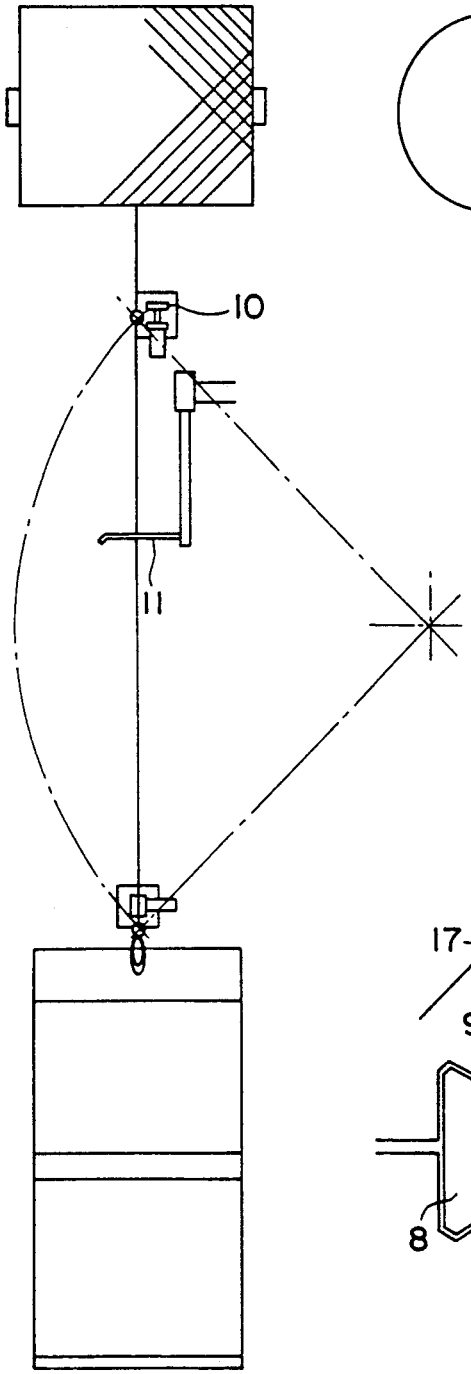
FIG. 1B shows, in schematic view, a front view of a spinning unit of an open-end spinning machine.
Figure 1A:
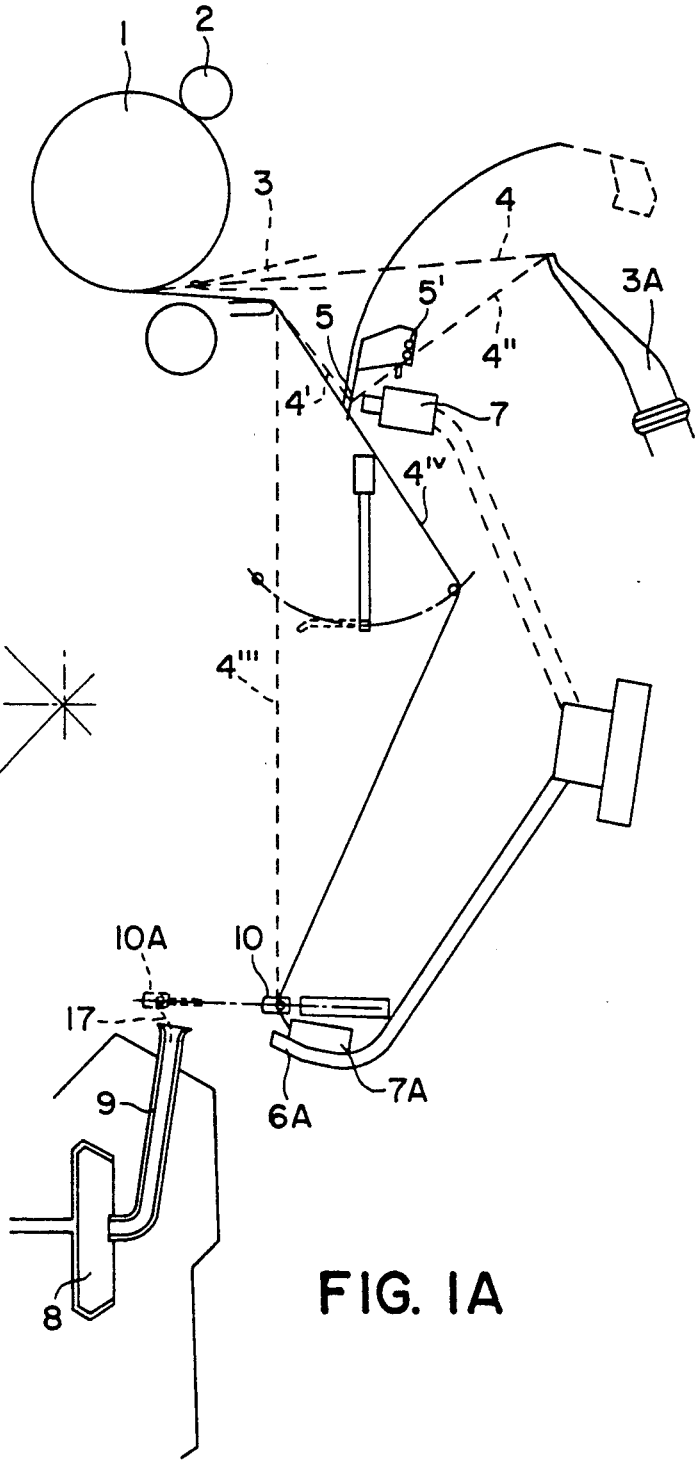
FIG. 1A shows, in schematic view, a side view of a spinning unit in an open-end spinning machine.

FIG. 1A shows a side view of the spinning unit and FIG. 1B a front view thereof.

Reel 1, on which is the thread end to be used for rejoining, is rotated slowly and in the opposite direction by the action of an auxiliary rotating roller 2 which is brought against it in order slowly to unwind the thread.

A suction nozzle 3 is brought close to the generatrix of the reel and picks up the thread end, which is paid out to it by the counter-rotation of reel 1.

If, however, the spinning frame is to be started or a new reel of thread begun, thread end 4 is picked up—instead of from the reel of thread 1 already produced—from a reserve of thread on board the spinning frame.

The nozzle withdraws to position 3A taking with it thread 4. An arm with a V-shaped introducer 5 descends to position thread 4 in front of a suction nozzle 6 of end-preparation device 7, the components of which will be described later in more detail. Thread 4 is now in a V configuration with one part 4' and one part 4'' upstream and downstream respectively of introducer 5.

Introducer 5 has a cutter 5' which cuts thread 4 while nozzle 6 produces a suction effect; on cutting the thread, part 4'' is sucked up by nozzle 3, whereas the end of part 4' is picked up by nozzle 6 while the reel continues to pay out thread.

The thread is now delivered to nozzle 6 of the preparation device. Nozzle 3 and introducer 5 can withdraw to the at-rest position.

Preparation device 7 rotates to position 7A opposite spinning rotor 8 and end-introduction pipe 9. Its rotation from position 7 to position 7A takes place around an axis lying in the plane of FIG. 1A, as shown in FIG. 1B. The thread is in position 4'''. In this rotation the thread follows the edge of nozzle 6 at an angle equal to the rotation and encounters open clamp 10, entering its jaws. A diverter rod 11 approaches thread 4''' and diverts it to assume configuration 4'$^{v}$ shown by an unbroken line, so as to make available a set length of thread between reel I and spinning rotor 8, in order to reintroduce the end along a constant and exact length.

Reel 1 is stopped and clamp 10 closed. Roller 2 is moved away from reel 1 and placed in the at-rest position.

FIGS. 2A, 2B and 2C, which are side, plan avid cross-sectional views respectively, show the preparation device according to the invention, the preceding part of the procedure of picking up and presenting thread 4 being already known in the state of the art at least as regards its essential aspects.

According to the present invention, thread-preparation organ 7 is integral with the device that picks up and feeds thread 4 to spinning rotor 8 in order to resume or start spinning so that problems of precision positioning and movement between the two organs are avoided.

Suction nozzle 6 has a body which is not shaped as a straight, curved or broken line, and has a longitudinal slot 12 which, when the preparation device is in position 7A, constitutes the shortest route from clamp 10 to suction pipe 13 for thread 4, which spontaneously assumes the position shown in FIG. 2A, which represents a side view. Thread 4 is gripped by clamp 10 and the free end enters suction pipe 13 along whatever length it is and falls between the open cutters of cutter 14.

In this position thread 4 enters a corresponding slot 12' in the body of device 7, which has a through channel 15, essentially at right angles to the direction of slots 12 and 12'.

Cutter 14 is closed and the section of thread beyond the cutter, sucked away by pipe 13, is cut whereas the end cut to size, held by clamp 10, enters channel 15, which is blasted through with a vigorous air flow in the direction of the arrow.

This air flow is supplied to channel 15 at the same time or subsequent to cutting the excess section of thread 4.

Inside channel 15 is a flexible blade 16, embedded in the wall of channel 15 or fixed by equivalent means, which due to the effect of the air flow vibrates vigorously, causing in the end of thread 4—stressed by the vibration of the blade and by the air flow—a series of flexural oscillations which release the short fibers, tapering the end and untwisting its fibers. In a very short time the thread end assumes a fairly long tapered configuration, with the fibers parallel and free of lengths of short fibers which would give rise to poor mechanical strength in the section containing the join.

In the state of the art the use of vibrating blades to prepare thread ends for pneumatic knotting is known, for example in European Patent No. 53093 in the name of Fomento de Inversiones Industriales or Italian Application for Patent No. 19227 A/88 in the name of Mesdan SpA. These patents refer to the possibility of using vibrating-blade devices also to untwist threads produced in open-end spinning frames, but without mentioning the method of use of these devices in the context of an open-end spinning frame and in particular in rejoining.

The present invention solves the technical problem of using these devices to prepare the end of a single rejoining thread in open-end spinning frames, and in their inclusion in the service devices of the spinning frame itself, according to the requirements of the said spinning technique.

In the example of an embodiment shown in FIGS. 2, channel 15—in the part to the right of slot 12'—has a U section, the opening of the U facing the part from which the thread end comes after cutting with cutter 14. This arrangement facilitates insertion of the thread end into channel 15, where it comes into contact with blade 16, and makes it easier to fit the blade.

The thread end will enter channel 15, however, provided that the latter has a sufficiently large tubular section, since in this case too the flexibility of the thread allows the air flow to bend it and attract its end into channel 15 and lay it against the blade.

The U shape section of channel 15 is also preferred because a smaller cross-section is required to ensure that the end is introduced into the channel.

After preparing the end, clamp 10 moves to position 10A to present the prepared end 17 to pipe 9 of spinning rotor 8. As rotor 8 rotates, it creates a vacuum and pipe 9 sucks end 17 in.

Thread-tightener rod 11 moves slightly back paying out the length required for end 17 to be caught and held by the suction of pipe 9, clamp 10 opens and releases the end to pipe 9.

When rotor 8 reaches the required speed and its groove contains the ring of singularised fibers suitable for rejoining, thread-tightener 11 completely releases thread 4. As an indication, the thread length suitable for introduction into the rotor for rejoining corresponds to just less than the circumference of rotor 8.

After a short precisely-determined time, the thread extraction rollers, not shown in the figure, are activated and thread winding is resumed to form reel 1.

Preparation of the thread according to the invention enables an end of the desired shape and length to be created.

These characteristics of the prepared thread are dependent on the position of blade 16 in channel 15, in relation to the thread end.

It has in fact been found that the length of the thread end which goes beyond the end of the free extremity of blade 16 has a substantial influence on the result of the preparation, the other treatment parameters being equal, and it is therefore necessary to be able to vary this length to suit the yarns produced in the spinning frame. This may be done by changing the position of cutter 14 along the body of nozzle 6—possibly by changing the position of clamp 10 immediately after cutting the end—and/or changing the position of blade 16 in relation to slot 12, for example by replacing only the part containing U-shaped channel 15 with another component having blade 16 in a different position. Depending on the count and twists of thread 4, preparation may be altered by changing the speed of the air flow in the channel, throttling its supply, and the treatment times, As an indication, the finer yarns with more twists require more drastic treatment conditions, i.e. longer times and higher flow speeds, which means higher air supply pressures. As an indication, the treatment times vary from 0.2 to 2 seconds, while the pressure of the service air varies from 3 to 7 bar.

The thicker yarns are more rigid and placed under greater stress by the vibration of the blade and their preparation requires milder conditions. The length of the tapered section is limited by the length of the fibers, but the relative position of the blade enables its shape to be determined within this limit.

Vibrating blade 16 may be made of a natural or synthetic elastomer material or of metal, for example spring steel. In any case, the edges and surfaces of the blade should preferably not be rough or have abrasive profiles which would damage the fibers. Treatment using a vibrating blade is more sensititve and adjustable than the state of the art treatments and does not damage the fibers, being based on a series of flexures induced at the resting point of the blade which loosen the links between the fibers and stretch them out.

As an alternative to the operating method described whereby compressed air is blown through channel 15, the blade may be made to vibrate by state of the art electric or mechanical devices, regulating the amplitude and period.

The device according to the invention is preferably fitted on board the service carriage of the spinning frame which serves the various spinning units that make up the open-end spinning frame. This carriage also has service devices which are used for starting, lifting, cleaning and rejoining the thread of the spinning units, such as devices for catching the thread end, on which preparation of the thread according to the invention is carried out, and its subsequent feeding to the spinning rotor.

We claim:

1. A method for preparing a thread end to give it a tapered end of constant and predetermined length, comprising untwisted essential parallel and integral fibers, said prepared thread end to be used to start or resume open-end spinning in an open-end spinning unit having a spinning rotor and an end-introduction pipe, the thread to be prepared being delivered form a thread reserve, said method comprising in sequence the steps of:

(a) unwinding the thread end form the thread reserve;
(b) picking up said unwound thread end by means of suction;
(c) transferring said picked up thread end opposite the end-introduction pipe of the open-end spinning unit;
(d) diverting and tightening the thread;
(e) stopping said thread unwinding;
(f) clamping the thread at a clamping point;
(g) cutting the thread end a predetermined distance from said clamping point or making a fixed thread length;
(h) feeding said cut thread end into a channel having disposed therein a flexible blade having a free extremity disposed inside said channel and supplying a vigorous air flow through said channel, whereby said blade is vibrated by means of said air flow;
(i) placing said cut thread end inside said channel in contact with said vibrating blade so that a portion of said cut thread end extends beyond the free extremity of the blade and so as to subject said cut thread end for a predetermined time to a large number of flexures of the blade, whereby the end of thread which extends beyond the free extremity of said blade is prepared by being freed of short fibers, tapered, and untwisted and parallelly oriented;
(j) moving said thread clamping point and said prepared thread end in proximity to the end-introduction pipe;
(k) releasing said thread clamping point and a portion of said diverted and tightened thread;
(l) sucking said fixed thread length and said prepared thread end into the end-introduction pipe; and
(m) completely releasing said diverted and tightened thread for totally recovering said fixed thread length and for feeding said prepared thread end into the spinning rotor of the open-end spinning machine for starting or resuming open-end spinning.

2. The method according to claim 1, wherein the preparation o the cut thread end is regulated by the axial position of the thread end in relation to the free end of the vibrating blade in the channel.

3. The method according to claim 2, wherein the axial position of the cut thread end in relation to the free end of the vibrating blade is adjusted by changing the constant and predetermined length to which the thread end is cut.

4. The method according to claim 3, wherein the preparation of the cut thread end is regulated by the duration of the vibrations of said blade by said air flow.

5. A device for preparing a thread end for starting or resuming spinning in an open-end spinning machine, wherein the open-end spinning machine has a thread reserve, a spinning rotor, and an end-introduction pipe, wherein the thread to be prepared is delivered from the thread reserve, and wherein the device comprises an integral catching, holding, and preparation means comprising a preparing means rotatable between a first position proximate the thread reserve and a second position opposite the thread introduction pipe, wherein the device includes:

a) catching and retaining means for catching the thread delivered from the thread reserve and for holding said caught thread as said integral catching, holding, and preparation means rotates from said first position to said second position, wherein said catching and retaining means comprises a first body with a longitudinal slot therein, a suction nozzle in said first body for catching the thread delivered form the thread reserve, a suction pipe connected to said suction nozzle, and wherein aid catching, holding, and preparation means further comprises a second body with a slot therein, and a channel positioned within said second body, wherein said second body slot is in a substantially traverse direction to said channel and opposite said longitudinal slot in said first body for receiving a thread therefrom;

b) clamping means for holding the end of said caught thread in position for preparation thereof;

c) cutting means or cutting said held end in said clamping means a predetermined distance from said clamping means for thereby providing a free thread end to be prepared;

d) feeding means for feeding at least a portion of said free thread end for preparation thereof; and e) said preparing means for preparing said free thread end for starting or resuming open-end spinning, wherein said preparing means comprises:

1) a channel for recovering said portion of said free thread end from said feeding means;

2) means for supplying an air flow through said channel substantially parallel to the length of said free thread end; and 3) means for vibrationally impacting said free thread end in response to said air flow, whereby said free thread end is freed of short fibers, and is untwisted; and wherein the device further comprises a thread diverting and tightening means positioned between said first and said second position of said thread catching, holding, and preparation means for making a fixed thread length when said catching, holding, and preparation means is positioned in said second position and before said clamping means holds the end of said caught thread, and wherein said fixed thread length is recovered when said prepared thread end is introduced into the end-introduction pipe of the open-end spinning machine.

6. The device of claim 5, wherein said longitudinal slot is in a straight line from said clamping means and said suction nozzle, and wherein said cutting means is disposed between said clamping means and said suction nozzle for cutting the thread to said predetermined length.

7. The device of claim 6, wherein said cutting means is adjustably positioned along said suction nozzle for varying said predetermined thread length cut by said cutting means.

8. The device of claim 6, wherein said clamping means is adjustably positioned along said suction nozzle for varying said predetermined thread length cut by said cutting means.

9. The device of claim 5, wherein said means for vibrationally impacting said free end of the thread includes a blade of elastomer or metal mounted inside said channel.

10. The device of claim 9, wherein said channel in said preparation means is U-shaped.

* * * * *